US007170362B2

(12) United States Patent
Kingston et al.

(10) Patent No.: US 7,170,362 B2
(45) Date of Patent: Jan. 30, 2007

(54) FERRITE CIRCULATOR HAVING ALIGNMENT MEMBERS

(75) Inventors: James Paul Kingston, Pepperell, MA (US); Stanley Vincent Paquette, Dracut, MA (US)

(73) Assignee: M/A-COM, Inc., Lowell, MA (US)

( * ) Notice: Subject to any disclaimer, the term of this patent is extended or adjusted under 35 U.S.C. 154(b) by 1 day.

(21) Appl. No.: 10/894,812

(22) Filed: Jul. 20, 2004

(65) Prior Publication Data

US 2006/0017520 A1 Jan. 26, 2006

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 3,621,476 A * 11/1971 Naohiko ..... 333/1.1
4,145,672 A 3/1979 Piotrowski
4,276,522 A * 6/1981 Coerver ..... 333/1.1
4,791,389 A 12/1988 Wolfert
5,384,556 A 1/1995 Coles et al.
5,638,033 A 6/1997 Walker et al.
6,011,449 A 1/2000 Jussaume et al.
6,337,607 B1 1/2002 Genfan
6,504,445 B1 1/2003 Kocharyan
6,566,972 B2 5/2003 Paquette et al.
6,850,126 B2 * 2/2005 Kocharyan ..... 333/1.1
2003/0107448 A1 6/2003 Kocharyan ..... 333/1.1

FOREIGN PATENT DOCUMENTS

EP 0 005 801 12/1979

* cited by examiner

*Primary Examiner*—Stephen E. Jones

(57) ABSTRACT

A ferrite circulator having integrated alignment members and a method for aligning a ferrite element within a ferrite circulator are provided. The ferrite circulator includes a ferrite circulator housing having a body for receiving at least one ferrite element therein. The ferrite circulator housing further includes a plurality of alignment members positioned and configured to maintain the alignment of the at least one ferrite element in an alignment region defined by the plurality of alignment members.

19 Claims, 3 Drawing Sheets

FERRITE CIRCULATOR HAVING ALIGNMENT MEMBERS

BACKGROUND OF THE INVENTION

This invention relates generally to microwave devices, and more particularly, to a ferrite circulator having integrated alignment members.

Ferrite circulators are typically configured as multi-port (e.g., three-port) passive RF or microwave devices having magnets and ferrite material that may be used to control the direction of signal flow in, for example, an RF circuit or a microwave circuit. For example, ferrite circulators may be used to control signal flow in wireless base station or power amplifier applications.

In general, a ferrite circulator or junction ferrite circulator is a multi-port device, such as a three-port device, having a symmetrical Y-junction formed by a magnetically biased ferrite disk or slab that is often used as a diplexer. The circulator allows flow of, for example, microwave energy in one direction (e.g., from one of three ports to another one of the three ports). In operation, a microwave signal entering one of the ports of the ferrite circulator follows a rotating sense based on the interaction of the electromagnetic wave with the magnetized ferrite. Thus, by symmetrically constructing the ferrite circulator, a defined signal path or direction through the ferrite circulator may be provided. Ferrite circulators also may be used to protect against reflections by terminating one of the ports of the ferrite circulator to thereby provide isolation.

In order for the ferrite circulator to properly operate (e.g., properly control signal flow therethrough), proper alignment of ferrite within the ferrite circulator must be provided. Specifically, the ferrite and center conductor must be precisely positioned and maintained relative to the housing in order to provide proper operation. It is known to provide alignment devices in connection with the ferrite circulator and/or to use epoxy to ensure proper alignment of the ferrite within the housing of the ferrite circulator. For example, it is known to use a plastic aligning frame or aligning disc member in connection with the ferrite circulator to ensure proper alignment of the ferrite within the housing of the ferrite circulator.

These known alignment devices add complexity and cost to the ferrite circulators. Further, the likelihood of misalignment of ferrite within the housing of the ferrite circulator increases due to improper positioning or affixing of the alignment device within the housing.

BRIEF DESCRIPTION OF THE INVENTION

According to an exemplary embodiment, a ferrite circulator housing is provided that includes a body for receiving at least one ferrite element therein. The ferrite circulator housing further includes a plurality of alignment members positioned and configured to maintain the alignment of the at least one ferrite element in an alignment region defined by the plurality of alignment members.

According to another exemplary embodiment, an alignment system for a ferrite circulator is provided that includes a plurality of posts extending from a bottom surface of a housing of a ferrite circulator. The plurality of posts are integrally formed with the housing. The alignment system further includes an alignment region defined by the plurality of posts for receiving a ferrite element and aligning the ferrite element within the housing.

DETAILED DESCRIPTION OF THE INVENTION

Figure 1:
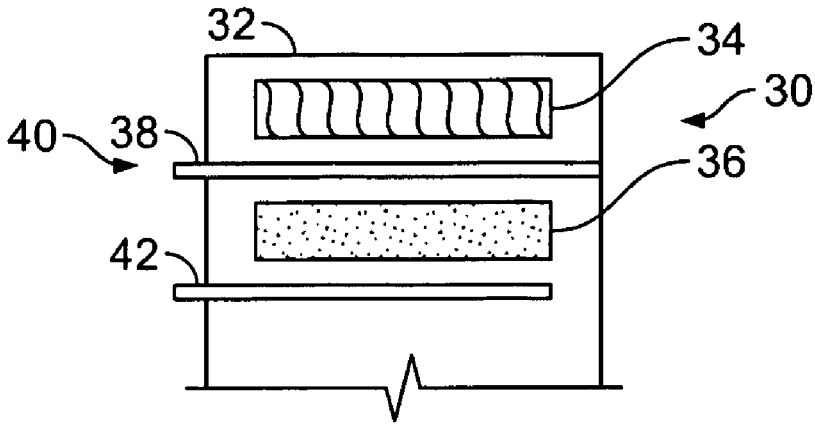
FIG. 1 is a diagram of an exemplary embodiment of a ferrite circulator.

FIG. 1 illustrates an exemplary embodiment of a ferrite circulator 30 in accordance with an exemplary embodiment. The ferrite circulator 30 generally includes a housing 32 defined by a body having a one or more magnets 34 and one or more ferrite elements 36 (e.g., ferrite slab or disk) aligned therein. The housing 32 is constructed of a metal, such as, for example, steel or aluminum, and which in one embodiment forms a cylindrical cavity resonator.

The ferrite circulator 30 also includes a plurality of stripline circuits 38 (only one of the stripline circuits 38 is shown in FIG. 1) defining ports 40 of the ferrite circulator 30. For example, a Y junction ferrite circulator 30 may be formed by providing three stripline circuits 38 defining three different ports 40. The ferrite circulator 30 also may include a ground plane 42 for establishing a ground reference within the ferrite circulator 30. It should be noted that a dielectric (not shown) between different components, for example, between the ground plane 42 and stripline circuit 38 may be provided within the housing 32 of the ferrite circulator 30.

Further, although only one magnet 34 and one ferrite element 36 are shown, additional magnets 34 and ferrite elements 36 may be provided in a stacked arrangement within the housing 32. Also, additional stripline circuits 38 defining additional ports 40 may be provided (e.g., four stripline circuits defining a four-port ferrite circulator 30).

Figure 2:
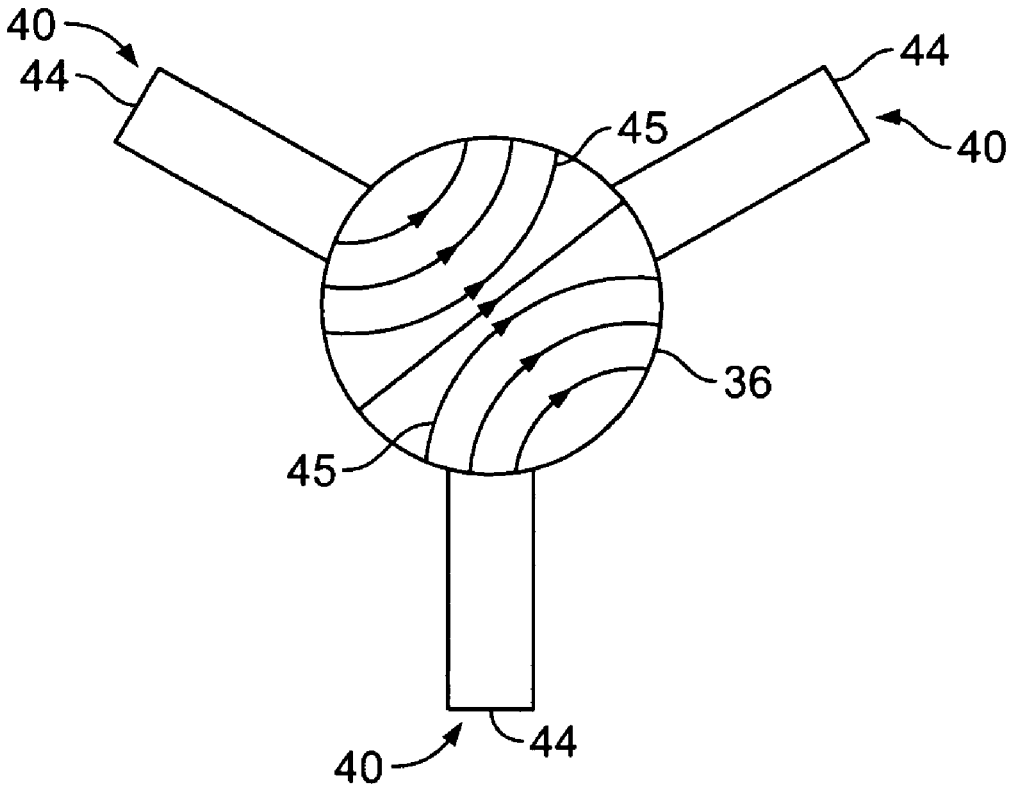
FIG. 2 is a diagram illustrating electric field configurations controlling the operation of a ferrite circulator.

In operation, and as shown in FIG. 2, power may be applied to any one of a plurality of transmission lines 44 defined by ports 40 that are formed by stripline circuits 38 extending outside the housing 32. When power is applied to one of the plurality of transmission lines 44, a standing wave pattern 45 is established. This electromagnetic field pattern is caused by counter-rotating waves created within the housing 32. It should be noted that coupling and isolation within the ferrite circulator 30 are determined by the relative position of a port 40 and the standing wave pattern.

The presence of an induced axial magnetic field across the ferrite element 36 changes the effective permeability experienced by the rotating waves based upon the sense of rotation. This causes rotation of the standing wave patterns. For example, the ferrite circulator 30 may be configured such that the power transfer and isolation properties are provided such that the standing wave pattern is rotated thirty degrees. Additionally, one of the ports 40 may be internally terminated to provide a two-port isolator.

Figure 3:
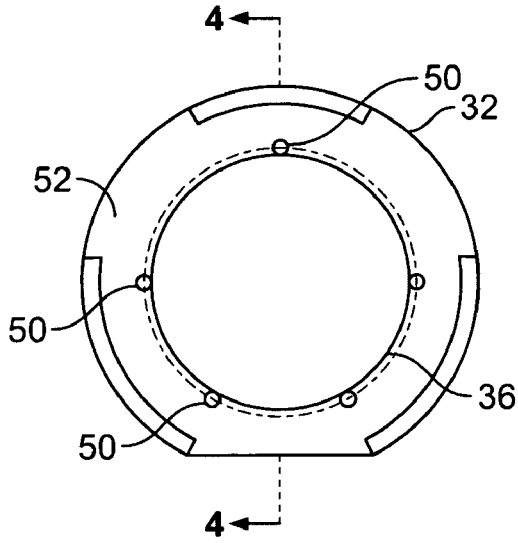
FIG. 3 is a top plan view of a ferrite circulator housing constructed in accordance with an exemplary embodiment of the invention.
Figure 4:
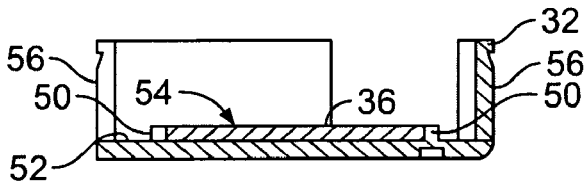
FIG. 4 is a section view of the ferrite circulator housing of FIG. 3 taken along the line 4—4.

Various embodiments of the invention provide for aligning the ferrite element 36 within the housing 32. Specifically, and as shown in FIGS. 3 and 4, a plurality of alignment members 50 integrally formed as part of the housing 32 to align a ferrite element 36 therein are provided as described in more detail herein. The plurality of alignment members 50 extend generally perpendicularly to a plane of a bottom surface 52 of the housing 32, for example, as protrusions, to define an alignment region 54 for maintaining therein a ferrite element 36. The alignment region 54 is provided as a generally planar area for supporting the ferrite element 36 substantially horizontally relative to sides 56 (e.g., walls) of the housing 32 and between the alignment members 50.

It should be noted that the number and configuration of the alignment members 50 may be modified as desired or needed. For example, although the alignment members 50 are shown as generally cylindrical posts, the shape of the alignment members 50 may be provided having, for example, a square, rectangular, octagonal or other geometric shaped cross-section. Further, the height of the alignment members 50 may be modified to accommodate (e.g., receive in the alignment region 54) and maintain therein more than one ferrite element 36 provided in a stacked arrangement.

Further, the number and positioning of the alignment members 50 may be modified to accommodate different sizes and shapes of ferrite elements 36. For example, the alignment members 50 may be arranged to define a square, rectangular, octagonal or other geometrically shaped alignment region 54 for receiving and maintaining therein or therebetween a correspondingly shaped ferrite element 36.

Further, in various embodiments, the alignment region 54 defined by the plurality of alignment members 50 is sized smaller than the magnet 34 (shown in FIG. 1). For example, the alignment region 54 may have a diameter approximately twenty percent smaller than the diameter of the magnet 34. Further, and for example, the height of the alignment members 50 may be about equal to the thickness of the one or more ferrite elements 36 or may be sized slightly higher than the one or more ferrite elements 36 (e.g., five percent higher).

The alignment members 50 are integrally formed as part of the housing 32 in the various embodiments. For example, the alignment members 50 may be formed into the housing 32 using a machining, stamping, casting and/or molding process, which may be a single or multiple step process. For example, in one exemplary embodiment, a two step process is performed to form the alignment members 50 and alignment region 54. Specifically, in a first step the alignment members 50 are formed (e.g., by stamping or pulling up posts from the bottom surface 52) and in a second step, the planar alignment region 54 is formed. In operation, this two step process may include, for example, a first machining strike to form the alignment members 50 (e.g., posts) and a second machining strike to flatten the alignment region 54 to provide a planar surface.

During the manufacturing process, the alignment members 50 may be formed at any position along the bottom surface 52 of the housing 32. In one embodiment, the alignment members 50 are centered in the housing 32 relative to the sides 56 (e.g., walls) of the housing 32. However, the number and positioning of the alignment members 50 may be provided at any location along the bottom surface 52 of the housing 32.

It further should be noted that the integral forming of the alignment members 50 as part of the housing 32 to form a single unitary piece may be provided by any suitable process, including, but not limited to, shearing, extruding, punching, etc. In a molding or casting process, the alignment members 50 may be formed in the housing 32 at the time of molding or casting, or as part of a secondary step.

Figure 5:
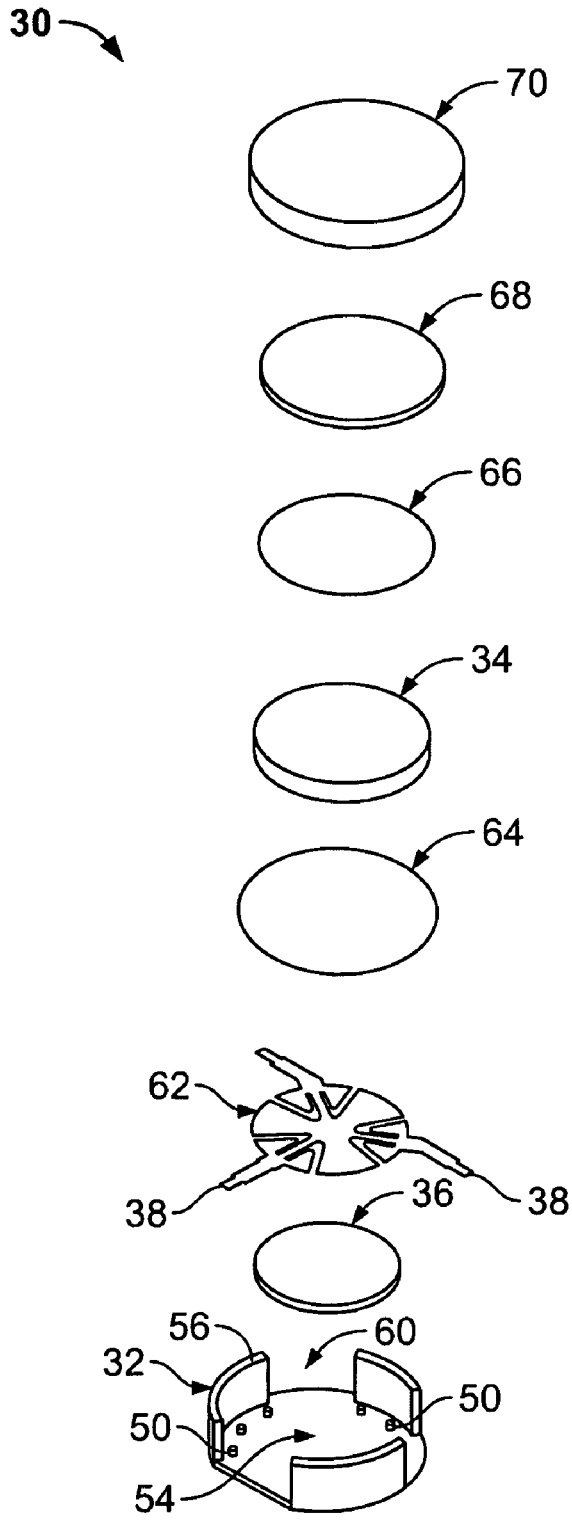
FIG. 5 is an exploded perspective view of a ferrite circulator in accordance with an exemplary embodiment of the invention.

Thus, as shown in FIG. 5, a ferrite circulator 30 having a housing 32 with integrally formed alignment members 50 is provided. For example, a dimpled housing 32 or a housing 32 having posts formed thereon may be provided. It should be noted that the housing 32 is constructed having a plurality of openings 60 formed in the sides 56 to allow extension therefrom of stripline circuits 38 to define ports 40 of the ferrite circulator 30.

As shown, one or more ferrite elements 36 (e.g., ferrite disks) are inserted within the alignment region 54 defined by the plurality of alignment members 50. A circuit element 62, comprising a plurality of stripline circuits 38 is provided on top of the ferrite element 36. A spacer 64, which may be formed of a dielectric material is then provided between the circuit element 62 and a magnet 34. A pole piece 66 is provided on top of the magnet 34 and a cover return 68 is provided on top of the pole piece 66. A cover 70 is then provided on top of the cover return 68.

It should be noted that the spacer 64 is provided between the circuit element 62 and the magnet 34 to minimize the "lossyness" of the circuit element 62 that would occur if the magnet 34 contacts the circuit element 62. Further the pole piece 66 and return cover 68 are provided and configured to focus the magnetic fields within the housing 32 as is known and to direct flow of energy therethrough. Also, in various embodiments, the cover 70 is spring loaded to apply a downward force on the components within the housing 32 to maintain the position and alignment of the components therein. The cover 70 and housing 32 may have complimenting locking or latching portion to secure the cover 70 to the housing 32 (e.g., snap fit).

Figure 6:
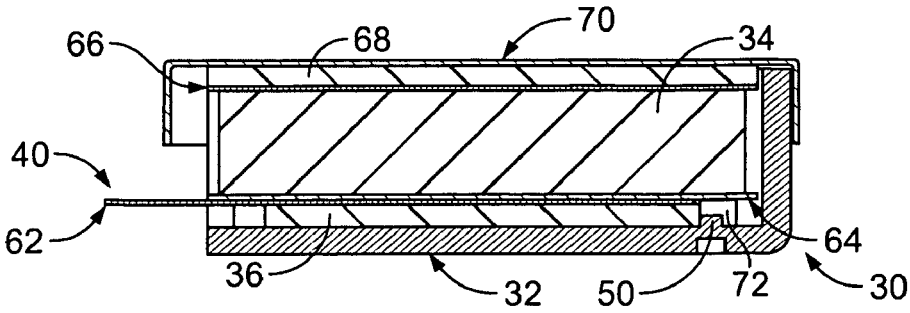
FIG. 6 is a section view of a ferrite circulator in accordance with an exemplary embodiment of the invention.

Thus, as shown in FIG. 6, a ferrite circulator 30 is constructed having a stacked arrangement of components therein with the ferrite element 36 maintained in alignment with the other components using the plurality of alignment members 50. The various components may be secured to one another, for example, by glue, epoxy or other suitable material. Additionally, the components may be maintained in position relative to each other by a force supplied by the cover 70. As described herein, the number and configuration of each component (e.g., the number and shape of ferrite elements 36) may be modified as desired or needed, for example, based upon the application or system requirements for the ferrite circulator 30.

As shown in FIG. 6, the alignment region 54 for maintaining the position of the ferrite element 36 is generally smaller in diameter than the other components of the ferrite circulator 30 such that a gap 72 is provided between the plurality of alignment members 50 and the sides 56 of the housing 32. Essentially, the plurality of alignment members 50 are spaced a distance from the sides 56 of the housing 32. The other components of the ferrite circulator 30 are configured in a stacked arrangement on top of the ferrite element 36 as is known.

While the invention has been described in terms of various specific embodiments, those skilled in the art will recognize that the invention can be practiced with modification within the spirit and scope of the claims.

What is claimed is:

1. A ferrite circulator housing comprising:

a body having a surface for receiving at least one ferrite element therein and including a plurality of alignment members, the body and the plurality of alignment members forming a single unitary piece with the plurality of alignment members separate from and positioned radially inward from sides of the body and configured to maintain the alignment of the at least one ferrite element in an alignment region of the surface defined by the plurality of alignment members.

2. A ferrite circulator housing in accordance with claim 1 wherein the plurality of alignment members extend generally perpendicularly from a bottom surface of the body.

3. A ferrite circulator housing in accordance with claim 1 wherein the alignment region comprises a generally planar surface.

4. A ferrite circulator housing in accordance with claim 1 wherein the plurality of alignment members are configured as protrusions formed as posts extending from a bottom surface of the body.

5. A ferrite circulator housing in accordance with claim 1 wherein the plurality of alignment members are formed in a first machining process and the alignment region is formed in a second machining process.

6. A ferrite circulator housing in accordance with claim 1 wherein the plurality of alignment members are configured to maintain the ferrite element generally centered within the body.

7. A ferrite circulator housing in accordance with claim 1 wherein the plurality of alignment members are configured to define an alignment region having a shape and size corresponding to at least one ferrite element.

8. A ferrite circulator housing in accordance with claim 1 wherein a height of the plurality of alignment members is configured based on a thickness of the at least one ferrite element.

9. A ferrite circulator housing in accordance with claim 1 wherein the plurality of alignment members are formed by stamping during one of a molding and casting process.

10. A ferrite circulator housing in accordance with claim 1 wherein the plurality of alignment members are integrally formed as part of the body.

11. An alignment system for a ferrite circulator, said alignment system comprising:

a plurality of posts extending from a bottom surface of a housing of a ferrite circulator, said housing having housing walls with the plurality of posts and housing walls integrally formed with the housing as a single unitary piece, said plurality of posts spaced a distance from said housing walls of the housing; and an alignment region defined by the plurality of posts for receiving a ferrite element and aligning the ferrite element within the housing.

12. An alignment system in accordance with claim 11 wherein the plurality of posts extend generally vertically perpendicularly from the bottom surface of the housing.

13. An alignment system in accordance with claim 11 wherein the plurality of posts are positioned based on at least one of the size and shape of the ferrite element.

14. An alignment system in accordance with claim 11 wherein the plurality of posts are formed by a stamping process.

15. An alignment system in accordance with claim 11 wherein the plurality of posts define an alignment region for receiving a plurality of ferrite elements.

16. An alignment system for a ferrite circulator, said alignment system comprising:

means for receiving at least one ferrite element within a housing of a ferrite circulator; and means for maintaining alignment of the ferrite element within the housing and that forms a single unitary piece with the means for receiving that is separate from sides of the housing.

17. An alignment system in accordance with claim 16 wherein the means for maintaining comprises means for maintaining positioning of the ferrite element within the housing.

18. An alignment system in accordance with claim 16 wherein the means for maintaining in integrally formed with the means for receiving.

19. An alignment system in accordance with claim 16 further comprising means for securing the ferrite element within the means for receiving.

* * * * *